United States Patent [19]

Dretzka

[11] Patent Number: 4,820,210

[45] Date of Patent: Apr. 11, 1989

[54] LOWER GEARCASE SHIFT MECHANISM FOR MARINE PROPULSION DEVICE

[75] Inventor: Robert G. Dretzka, South Milwaukee, Wis.

[73] Assignee: Outboard Marine Corporation, Waukegan, Ill.

[21] Appl. No.: 122,221

[22] Filed: Nov. 18, 1987

[51] Int. Cl.[4] ..... B63H 23/08

[52] U.S. Cl. ..... 440/75; 192/51; 440/89

[58] Field of Search ..... 440/75, 86, 89; 192/53 F, 53 E, 51, 53 B

[56] References Cited

U.S. PATENT DOCUMENTS

| | | | |
|---|---|---|---|
| 2,284,589 | 2/1939 | Rippingille | 192/53 B |
| 2,319,366 | 2/1939 | Rippingille | 192/53 B |
| 2,718,792 | 8/1952 | Kiekhaefer | 74/378 |
| 2,814,373 | 8/1952 | Bixby | 192/53 B |
| 2,835,143 | 8/1950 | Kelbel | 192/53 B |
| 2,967,596 | 1/1961 | Page | 192/51 X |
| 3,467,051 | 3/1967 | Shimanckas | 440/89 |
| 3,585,873 | 6/1971 | Austen | 192/51 X |
| 3,818,855 | 6/1974 | Shimanckas | 115/34 R |
| 4,132,298 | 1/1979 | Geppert | 192/53 B |
| 4,560,355 | 12/1985 | McCormick | 440/86 |
| 4,583,628 | 4/1986 | McCormick | 192/76 |

*Primary Examiner*—Sherman D. Basinger

*Attorney, Agent, or Firm*—Michael, Best & Friedrich

[57] ABSTRACT

The invention provides a marine propulsion device having a lower unit including a power transmission mechanism comprising a bevel gear having a first clutch element, a propeller shaft having a second clutch element and mounted for rotational movement and for axial movement between a neutral position and an engaged position with the propeller shaft clutch element in driven engagement with the first clutch element, a collar mounted on the propeller shaft for common movement therewith and for axial movement relative to the propeller shaft and into a frictional driving engagement with the bevel gear to effect rotation of the propeller shaft at a rate less than the rotational rate of the bevel gear, and a spring biasing the propeller shaft to the neutral position, the spring being overcome to afford movement of the propeller shaft to the drive position in response to propeller shaft rotation.

21 Claims, 2 Drawing Sheets

LOWER GEARCASE SHIFT MECHANISM FOR MARINE PROPULSION DEVICE

BACKGROUND OF THE INVENTION

The invention relates generally to marine propulsion devices, such as outboard motors and stern drive units, and particularly to reversing transmissions included in the gearcase section of the lower units of such marine propulsion devices.

Attention is directed to the following patents:

| | | |
|---|---|---|
| 2,284,589 | 2,835,143 | 4,132,298 |
| 2,319,366 | 3,467,051 | 4,560,355 |
| 2,718,792 | 3,818,855 | 4,583,628 |
| 2,814,373 | | |

SUMMARY OF THE INVENTION

The invention provides a marine propulsion device having a lower unit including a power transmission mechanism comprising a bevel gear having a first clutch element, a propeller shaft having a second clutch element and mounted for rotational movement and for axial movement between a neutral position and an engaged position with the propeller shaft clutch element in driven engagement with the first clutch element, selectively engageable means on the bevel gear and on the propeller shaft for rotating the propeller shaft at a rate less than the rotational rate of the bevel gear, and means biasing the propeller shaft to the neutral position, the biasing means being overcome to afford movement of the propeller shaft to the drive position in response to propeller shaft rotation.

In one embodiment of the invention, the first clutch element comprises a set of teeth on the bevel gear and the second clutch element comprises a set of teeth on the propeller shaft.

In one embodiment of the invention, the selectively engageable means comprises an annular surface on the bevel gear and a collar slideable on the propeller shaft. The propeller shaft collar has an annular surface for selective engagement and disengagement with the bevel gear annular surface.

In one embodiment of the invention, the marine propulsion device further comprises a means for selectively shifting the collar from an engaged to a disengaged position.

In one embodiment of the invention, the shifting means further comprises a biasing means for urging the collar toward the bevel gear and the shifter biasing means is selectively overcome to disengage the collar annular surface from the bevel gear annular surface.

In one embodiment of the invention, the propeller shaft biasing means comprises a spring.

In one embodiment of the invention, the marine propulsion device also has a propeller attached to the propeller shaft for common rotation therewith. The rotating propeller creates thrust for overcoming the propeller shaft biasing means to afford movement of the propeller shaft to the drive position.

In one embodiment of the invention, the lower unit further comprises a first and a second bevel gear, each having a clutch element and an annular surface.

In one embodiment of the invention, the lower unit also comprises an exhaust gas discharge passageway terminating in an exhaust gas discharge port. The propeller has a generally hollow cylindrical hub with a first and a second end and said first end disposed toward said discharge port. However, the exhaust gas port and the first end of the propeller hub are not in direct communication when the propeller shaft is in the drive position with the second clutch element in driven engagement with the first clutch element of the second bevel gear.

The invention also provides a power transmission mechanism for a marine propulsion device comprising a lower unit, a drive shaft terminated at its lower end by a drive pinion supported in said lower unit, a propeller shaft supported in the lower unit for rotation about its longitudinal axis and limited axial movement between a neutral and a drive position, a bevel gear in driven engagement with the drive pinion and circumferentially spaced about the propeller shaft and in interlocking engagement with the propeller shaft when the propeller shaft is in a drive position, a means mounted on the propeller shaft for rotation with the propeller shaft and limited axial movement with respect to said propeller shaft and for contacting engagement with the bevel gear, and a means for selectively shifting the contacting engagement means into and out of contact with the bevel gear.

In one embodiment of the invention, the power transmission mechanism has a pair of bevel gears, each of which is in driven engagement with the drive pinion and circumferentially spaced about the propeller shaft on opposite sides of the drive pinion.

In one embodiment of the invention, the rotation of the propeller shaft and the attached propeller causes axial movement of the propeller shaft into the drive position.

The invention also provides a marine propulsion device having a lower unit comprising a propeller shaft having exterior splines along a portion of its length intermediate the ends supported in the lower unit for rotary movement and limited axial movement relative to said lower unit. The device also contains a bevel gear in circumferentially spaced relation to the propeller shaft, the gear having an annular surface and a set of interior pinion teeth. The device also includes a collar slideably mounted on the splines of the propeller shaft between the forward and reverse gears for rotational movement with the propeller shaft and selective slideable movement along the axis of the propeller shaft. The collar has an annular surface selectively mateable with the gear annular surface and the propeller shaft's splines are meshingly engageable with the interior pinion teeth.

In one embodiment of the invention, a propeller is fixedly mounted on the propeller shaft and the limited axial movement of the propeller shaft is caused by force generated by the rotation of the propeller.

In one embodiment of the invention, the lower unit further includes an exhaust system in which exhaust gas passes through the hub of the propeller while in the forward drive condition and passes between the hub and the gearcase while in the reverse drive condition.

It is a primary feature of the present invention to provide for the smooth shifting of a marine propulsion device in either a forward or reverse direction by initially mating a surface on a collar slideably mounted on the propeller shaft with a spinning surface of the selected gear. This contact initiates rotation of the propeller shaft and the associated propeller which causes axial force in either a forward or reverse direction depending on which direction is selected by the operator. The propeller shaft is mounted in the lower unit so as to allow slight axial movement of the propeller shaft. This axial movement allows splines in the propeller shaft to mesh with interior pinion teeth of the selected gear for positive continued rotation of the propeller shaft.

It is another feature of the invention that the propeller shaft be held in a centered position by means of centering springs that will slide the propeller shaft out of engagement with the gear pinion teeth when there is no axial force on the propeller shaft.

It is a further feature of the invention to incorporate this shifting mechanism with a through-hub exhaust system. When the propeller is shifted axially rearward while in reverse drive, exhaust gas can pass through the gap created between the propeller and the lower unit so that the propeller slices through clean water and its efficiency is not hindered by exhaust gas bubbles.

It is yet another feature of the invention to reduce the distance of collar travel needed to obtain forward or reverse gear ratio from the amount of travel needed in a conventional clutch dog shift system.

Other features and advantages of the embodiments of the invention will become known by reference to the following general description, claims and appended drawings.

IN THE DRAWINGS

Figure 1:
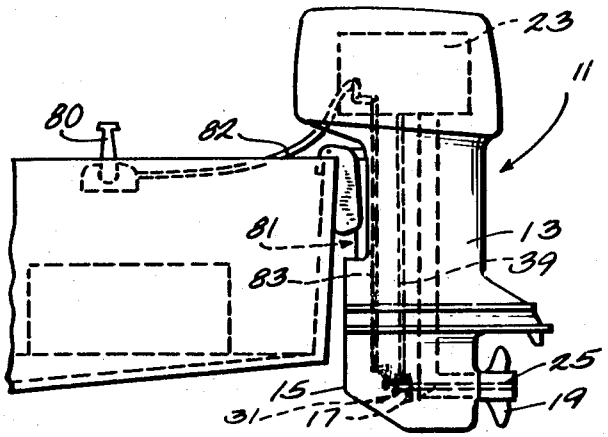
FIG. 1 is a perspective view of an outboard motor embodying various of the features of the invention.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in FIG. 1 is a marine propulsion device 11 comprising a lower unit 13 including a gearcase 15 supporting a propeller shaft 17 for rotary movement and for limited axial movement. Fixed on the propeller shaft 17 for common rotation therewith is a propulsion element in the form of a propeller 19.

The lower unit 13 also includes an exhaust gas passage system 21 through which passes exhaust gas from a prime mover, such as an internal combustion engine 23. In one embodiment, a substantial portion of this exhaust gas passes through a substantially hollow propeller hub 25 while the propulsion device is in the forward drive condition.

The invention can be practiced in any form of a marine propulsion system having a generally horizontal propeller shaft. For example, in addition to being incorporated in the gearcase of an outboard motor as shown in FIG. 1, the invention can be practiced in connection with a stern drive or an OMC Sea Drive marine propulsion unit.

The gearcase 15 also includes (see especially FIG. 2) a power transmission mechanism 31. In a preferred embodiment, this mechanism is a reversing transmission 31 which includes forward and reverse axially spaced facing bevel gears 33 and 35, each of which is in meshing engagement with a drive pinion gear 37 mounted at the lower end of a rotatable drive shaft 39 connected to the engine 23.

The forward and reverse gears 33 and 35 are supported for rotation co-axially with the propeller shaft 17 and against axial movement relative to the propeller shaft 17 and to the gearcase 15 by suitable bearing means including, in one embodiment, bearings 41, 43, 45 and 47.. The forward and reverse bevel gears 33 and 35 include respective inner bores 51 and 53 closely surrounding the propeller shaft 17. It should be noted that as long as the engine 23 is rotating, both bevel gears 33 and 35 will be spinning in opposite directions.

The reversing transmission 31 also includes means for selectively connecting and disconnecting the forward and reverse bevel gears 33 and 35 with the propeller shaft 17 so as to provide forward drive, neutral, and reverse drive conditions. Generally, the bevel gears 33 and 35 initially transmit force to the propeller shaft 17 by selectively engageable means (See FIG. 3) including a collar 61 which shuttles back and forth on splines 63 of the propeller shaft 17 between the forward and reverse bevel gears 33 and 35. The splines may be cut axially along the propeller shaft or may be cut with a sprial contour. After this initial contact, axial force generated from the rotation of the attached propeller 19 overcomes (See FIG. 2) biasing springs 67 and 69 and automatically causes axial movement of the propeller shaft 17 into forward or reverse drive position, which axial movement results in positive meshing engagement of a second clutch means comprising external splines 71 of the propeller shaft 17 and internal pinion teeth 73 and 75 on the bevel gears 33 and 35.

The movement of the collar 61 between the forward and reverse bevel gear engaging positions is controlled by shift means 81 which is operator activated. This shift means 81 allows limited axial movement of the collar 61 along the propeller shaft 17 in response to operator actuated movement of a shift rod 83 to affect shifting from neutral to either forward or reverse drive.

The shift means 81 shown in the drawings comprises an operator actuated lever 80 connected to a push/pull cable 82. The cable is in turn connected to a long vertical shift rod 83 positively connected to a detent 85 to cause vertical motion of the detent 85 in association with operator actuated motion of the lever 80. The detent 85, in turn, actuates a shifter lever or bell crank 87 which has generally parallel pairs of horizontal and vertical arms 91 and 93 and which is pivoted about an axis 95. The shifter lever 87 translates the vertical motion of the shift rod 83 and detent 85 into horizontal motion of a cradle 97 and associated shift shaft 99.

In one embodiment, the shift means 81 can also contain resilient biasing means for maintaining axial force on the collar 61 when it is in contact with either the forward bevel gear 33 or the reverse bevel gear 35 to urge continued engagement with the respective bevel gear. In one embodiment, the inherent resilience of the push/pull cable 82 and the flexibility of the vertical rod 83 act as the shifter biasing means to give the shift means a resilience which acts to bias the collar 61 to the selected gear and maintain pressure on that gear. The shift means 81 can also include a centering detent to maintain the collar 61 between the bevel gears 33 and 35 in the absence of operator actuation.

The ends of each of the vertical arms 93 of the bell crank 87 fit into a slot 101 in the cradle 97 on either side of the horizontal shift shaft 99. The shift shaft 99 is disposed in an axial bore 103 extending into the propeller shaft 17 for common rotation with the propeller shaft 17 and for limited axial motion relative to the propeller shaft 17. Extending through a close fitting aperture near the end of the shift shaft 99 opposite the cradle 97 is a shifter pin 105. The shifter pin 105 also extends through an axially elongated hole 106 in the propeller shaft 17 and close fitting apertures in the collar 61. The shifter pin 105 is held in place by a retainer spring 107 extending around the middle section of the collar 61. By this construction, vertical motion of the shift rod 83 is translated into horizontal motion of the collar 61, and the collar 61 is free to rotate with the propeller shaft 17 while the cradle 97 and bell crank 87 remain stationary.

The hollow cylindrical collar 61 is positioned along a portion of the propeller shaft 17 between the bevel gears 33 and 35. The collar 61 includes a propeller shaft attachment means, such as interior splines 111 which cooperatively engage the exterior splines 71 of the propeller shaft 17 to cause common rotational movement and free axial movement of the collar 61 with respect to the propeller shaft 17. The extent of the axial movement is limited by contact of respective cone surfaces 121 and 123 on the collar 61 with the forward or reverse bevel gear 33 and 35.

The exterior surface of the collar 61 includes an outer circumference having, at the ends thereof, the respective forward and reverse annular ramp cone surfaces 121 and 123. Each surface is ramped at approximately the same angle as are respective interior sloped surfaces 125 and 127 on the forward and reverse bevel gears 33 and 35. When the collar 61 is urged toward a selected one of the bevel gears 33 and 35, the ramp cone surfaces 121 and 123 have wide areas for contacting and engaging the associated sloped surface 125 or 127. Also on the exterior surface of the collar 81, between the ramp cone surfaces 121 and 123 is a groove 129 cut around the circumference of the collar 61 for holding the retaining spring 107 which retains the shifter pin 105.

As can be seen in the drawings, in the preferred embodiment, the ramped cone surfaces 121 and 123 and the complementary sloped surfaces 125 and 127 are both at a minor acute angle to the axis of the propeller shaft 17. Without detracting from the spirit of the invention, the selectively engageable means will work well if these surfaces are positioned at a more acute angle, in perpendicular relation to the propeller shaft 17, or even at an obtuse angle with respect to the propeller shaft 17.

Figure 3:
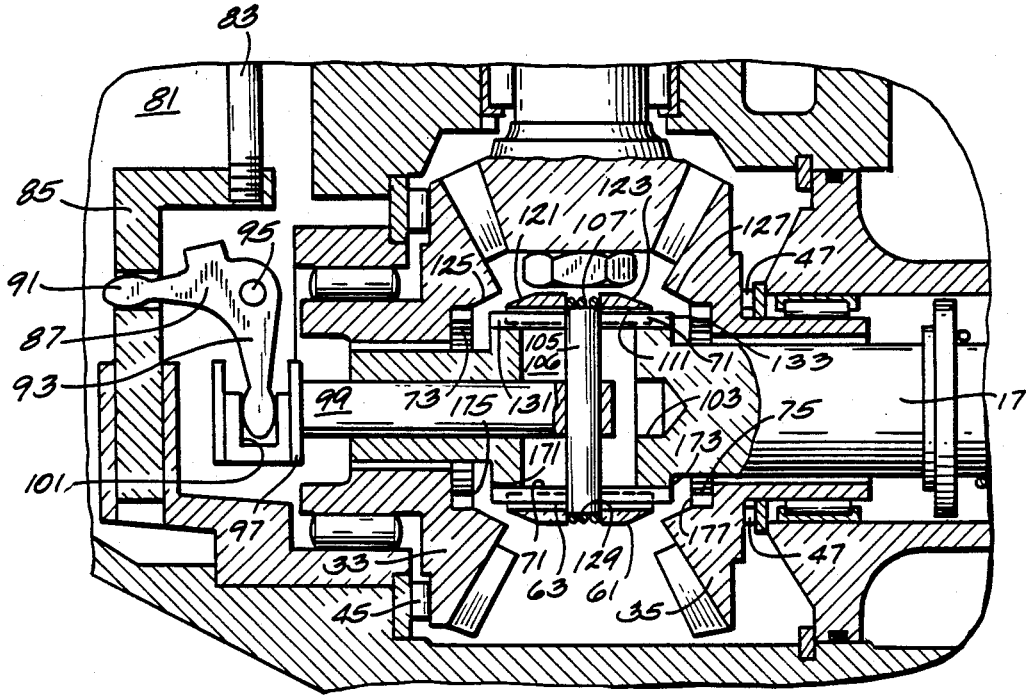
FIG. 3 is an enlarged sectional view of the central portion of FIG. 2.

Power from the engine 23 is initially transferred from one of the spinning forward and reverse bevel gears 33 and 35 to the propeller shaft 17 by means of engagement of the selected one of the forward and reverse ramp cone surfaces 121 and 123 when the selected surface initially contacts the associated and complementarily sloped one of the surfaces 125 and 127 on the bevel gears 33 and 35 (See FIG. 3). Once the propeller shaft 17 starts to turn, axial force is generated along the propeller shaft 17 by the propeller 19 which is fixed to the propeller shaft 17 at its aft end. When this force is greater than the force of the propeller shaft biasing means, such as the positioning springs 67 and 69, the propeller shaft 17 moves axially with respect to the gearcase 15 in the direction desired. When the rotational speed of the propeller shaft 17 is slower than, but approaching the rotational speed of the associated one of the bevel gears 33 and 35, one of the end portions 131 and 133 of the splines 71 on the propeller shaft 17 can mesh with the complementary pinion teeth 73 and 75 on the respective forward or reverse bevel gear 33 and 35. The result is positive, geared engagement of the drive shaft 39 with the propeller shaft 17.

Figure 2:
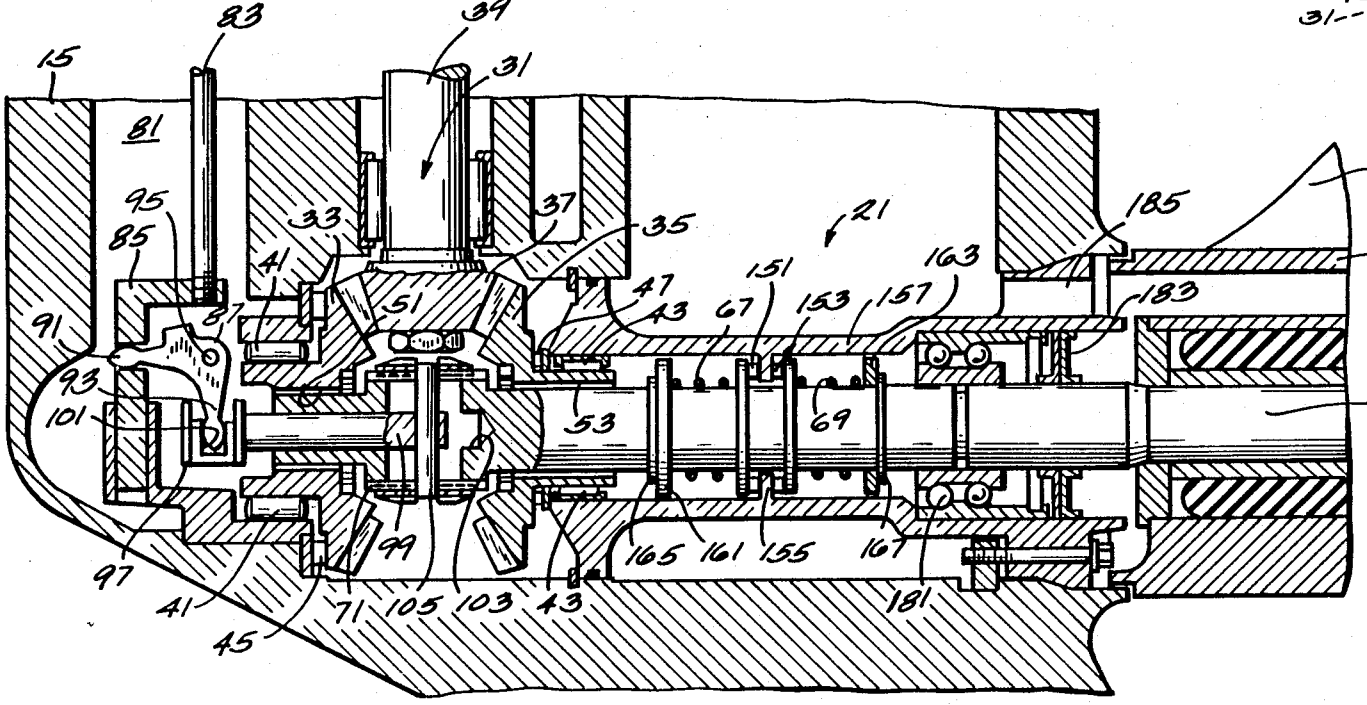
FIG. 2 is an enlarged sectional view of the gearcase with the transmission in the neutral position.

In a preferred embodiment, the propeller shaft 17 is normally positioned in the gearcase 15 with the exterior splines 71 between, and not in contact with, the forward and reverse bevel gears 33 and 35 by means of biasing means such as the pair of positioning springs 67 and 69 (See FIG. 2). The springs 67 and 69 respectively bear against bearings 151 and 153 which are respectively located on the opposite sides of a shoulder 155 which is gearcase 15 in close circumferential proximity to the propeller shaft 17. In one embodiment, the shoulder 155 may be a short diametrically reduced section of a propeller shaft bearing retainer 157 fixed to the gearcase 15 by any suitable means. The springs 67 and 69 also bear against respectively spring retaining means on the propeller shaft 17, the retaining means being positioned on opposite sides of the shoulder 155. In one embodiment, the retaining means are in the form of washers 161 and 163 and snap rings 165 and 167.

When the propeller shaft is centered, as in FIGS. 2 or 3, with its splines 71 out of contact with the bevel gears 33 and 35, the springs 67 and 69 are equally tensioned between their respective retaining means and the shoulder 155. When sufficient axial force in the propeller shaft 17 is created, as by the rotation of the propeller 19, the biasing force of the springs 67 and 69 is overcome and the propeller shaft moves axially in the direction desired.

The axial motion of the propeller shaft 17 is limited in the forward or reverse direction by lands 171 and 173 located respectively at the forward end and at the reverse end of the propeller shaft splines 71. The lands 171 and 173 contact vertical surfaces or stops 175 and 177 on the respective bevel gears 33 and 35. As stated earlier, the bevel gears 33 and 35 are retained against axial movement relative to the gearcase 15 by appropriate bearings 45 and 47. Near the aft end of the propeller shaft 17 is a bearing means 181 for radially supporting the propeller shaft and a suitable sealing means 183, such as a bellows seal, for keeping water out of the reversing transmission.

As can be seen in the drawings, the reversing transmission herein described can be used in conjunction with a gearcase 15 with an exhaust gas passage system 21 terminating in an exhaust discharge port 185 which, when the transmission is in forward drive, is in direct communication with the substantially hollow cylindrical hub 25 in the propeller 19. Thus exhaust gas passage system 21 allows exhaust gas from the engine 23 to pass through the discharge port 185 and the hub 96. However, in the device depicted in the drawings, a portion of the exhaust gas will escape from between the propeller hub 96 and the gearcase 15 when the propeller shaft 17 has been translated axially in the reverse direction. This allows the propeller 19 to see "hard" water (water with little or no exhaust bubbles) when rotating in the reverse direction. Such propeller rotation in "hard" water increases the holding power of the propeller blades.

While in the neutral position, the collar 61 is positioned between the forward and reverse bevel gears 33 and 35 as seen in FIGS. 2 and 3. The drive shaft 17 and drive pinion 37 are spinning at engine speed and cause the forward and reverse bevel gears 33 and 35 to rotate about the propeller shaft 17 in opposite directions.

When the operator selects forward drive, upward vertical motion in the shift rod 83 is translated into forward horizontal motion in the collar 61. In one embodiment, the force between the forward ramp cone surface 121 of the collar 61 and the tapered surface 125 of the forward bevel gear 33 is established by the resilience of the shift means to cause smoothly accelerated rotational movement of the propeller shaft 17.

Rotation of the propeller shaft 17, in turn, causes rotation of the propeller 19 which puts forward axial force on the propeller shaft 17. This forward force is initially resisted by the biasing spring 67. When the forward axial force exceeds the force of the biasing spring 67, the propeller shaft 17 will move axially forward and, as the rotational speed of the propeller shaft 17 approaches that of the bevel gear 33, the forward end portions 131 of the propeller shaft splines 71 cooperatively mesh with the interior pinion teeth 73 of the forward bevel gear 33. Such meshing causes positive drive connection between the forward bevel gear 33 and the propeller shaft 17. Shift by neutral to reverse drive is similar but utilizes the reverse bevel gear 35 and the associated collar and propeller shaft structure.

After the boat has been travelling in the forward direction and the operator wishes to slow down or stop, the operator can reduce the throttle and then actuate the shift mechanism 81 from the forward position to neutral position. The accompanying reduction in the throttle will cause a reduction in the forward force of the propeller 19. Once the forward force of the propeller 19 is less than the biasing force of the centering spring 67, the propeller shaft will shift to its centered position out of meshing engagement with the forward and reverse bevel gears 33 and 35. Once the throttle is sufficiently reduced, the shift means 81 can be easily moved to cause the collar 61 to disengage from contact with the forward bevel gear 33.

As stated above, resilient means, such as the inherent resilience in the shift mechanism 81, maintains an axial force on the clutch collar 61 when the clutch collar 61 is in contact with either one of the forward or reverse bevel gears 33 and 35. As long as the shift mechanism 81 has been actuated to a drive position, this resilient means forces the selected ramp cone surface of the clutch collar 61 to maintain contact with the associated bevel gear surface even if the propeller shaft 17 has shifted axially to a centered position and the bevel gear is not in direct meshing engagement with the propeller shaft 17. This resilient means aids in maintaining power transmission from the engine 23 to the propeller 19 when the boat is decelerating and when the propeller shaft 17 may otherwise slip out of meshing engagement with the previously engaged bevel gear. As can be seen in the drawings, the collar 61 traverses only a short axially distance between the forward and reverse bevel gears 33 and 35. Contrarywise, known prior art reversing transmissions a dog clutch is used, which dog clutch travels at least the axial length of the teeth thereon in order to engage and disengage the teeth of the dog clutch. The smaller collar travel distance permits transmission actuation with less movement of the shift mechanism 81, and thus smaller shift levers operating in less space can be employed.

Various of the features of the invention are set forth in the following claims.

I claim:

1. A marine propulsion device including a lower unit having a power transmission mechanism comprising a bevel gear having a first clutch element, a propeller shaft having a second clutch element and mounted in said lower unit for rotational movement and for axial movement between a neutral position and a drive position with said propeller shaft clutch element in engagement with said first clutch element, selectively engageable means on said bevel gear and on said propeller shaft for rotating said propeller shaft at a rate less than the rotational rate of said bevel gear and so as to facilitate engagement of said first and second clutch elements, and means biasing said propeller shaft to said neutral position in the absence of an overcoming force which is created by propeller shaft rotation and which displaces said propeller shaft to said drive position.

2. A marine propulsion device as set forth in claim 1 wherein said first clutch element comprises teeth on said bevel gear.

3. A marine propulsion device as set forth in claim 2 wherein said second clutch element comprises teeth on said propeller shaft.

4. A marine propulsion device as set for in claim 3 wherein said selectively engageable means comprises a first annular surface on said bevel gear, and a propeller shaft collar having a second annular surface and being slideable axially along said propeller shaft between an engaged position wherein said annular surfaces are engaged and a disengaged position wherein said annular surfaces are disengaged.

5. A marine propulsion device as set forth in claim 4 and further comprising means for selectively shifting said collar between said engaged and disengaged positions.

6. A marine propulsion device as set forth in claim 5 wherein said shifting means further comprises biasing means for urging said collar toward said bevel gear, said biasing means being selectively overcome to disengage said collar from said bevel gear.

7. A marine propulsion device as set forth in claim 4 wherein said propeller shaft biasing means comprises a spring.

8. A marine propulsion device as set forth in claim 7 and further including a propeller attached to said propeller shaft for common rotation therewith, said propeller creating thrust in response to rotation, which thrust overcomes said propeller shaft biasing means to afford movement of said propeller shaft to said drive position.

9. A marine propulsion device as set forth in claim 8 and further including a second bevel gear, having an additional first clutch element and an additional annular surface.

10. A marine propulsion device as set forth in claim 9 wherein said lower unit also includes an exhaust gas discharge passageway terminating in an exhaust gas discharge port, wherein said propeller has a generally hollow cylindrical hub with a forward end located adjacent to said discharge port, and wherein said exhaust gas discharge port and said forward end of said propeller hub are in spaced relation when said propeller shaft is located with said second clutch element in driven engagement with said first clutch element of said second bevel gear.

11. A power transmission mechanism for a marine propulsion device comprising a lower unit, a drive shaft in said lower unit and including a lower end, a drive pinion supported in said lower unit on said lower end, a propeller shaft supported in said lower unit for rotation about its longitudinal axis and for axial movement between a neutral position and a drive position, a bevel gear in driven engagement with said drive pinion and circumferentially spaced about said propeller shaft, a collar mounted on said propeller shaft for rotation in common with said propeller shaft and for axial movement relative to said propeller shaft and between a first position in frictional engagement with said bevel gear, whereby said collar and said propeller shaft are frictionally rotated by said bevel gear, and a second position free of frictional engagement with said bevel gear, means for selectively shifting said collar between said first and second positions, and interengageable means on said bevel gear and on said propeller shaft for direct engagement therebetween to positively rotate said propeller shaft in response to rotation of said bevel gear and in response to axial movement of said propeller shaft to said drive position incident to propeller shaft rotation consequent to frictional engagement of said collar and said bevel gear.

12. A power transmission means in accordance with claim 11 wherein said propeller shaft is biased toward the neutral position by a biasing means.

13. A power transmission means in accordance with claim 12 wherein said biasing means is a spring.

14. A power transmission means in accordance with claim 12 wherein a propeller is attached to said propeller shaft for common rotation therewith.

15. A power transmission means in accordance with claim 14 wherein the reaction of water on said propeller moves said propeller shaft axially to said drive position when said propeller shaft is rotating.

16. A power transmission means in accordance with claim 15 and further comprising a pair of said bevel gears in driven engagement with said drive pinion and circumferentially spaced about said propeller shaft on opposite sides of said drive pinion.

17. A power transmission means in accordance with claim 16 wherein said rotation of the propeller shaft and said attached propeller causes axial movement of said propeller shaft into said drive position.

18. A power transmission means in accordance with claim 17 having forward and reverse bevel gears in circumferentially spaced relation to said propeller shaft and on opposite sides of said drive pinion and with said forward gear being forward of said drive pinion, said bevel gears including respective annular surfaces, and said collar including a pair of annular surfaces selectively and respectively engageable with said annular surfaces on said bevel gears.

19. A power transmission means in accordance with claim 18 wherein said propeller shaft is urged forwardly by the rotation of the propeller when one of said annular surfaces on said collar mates with said annular surface on said forward bevel gear, and wherein said propeller shaft is urged rearwardly when the other of said annular surfaces on said collar mates with said annular surface on said reverse bevel gear.

20. A power transmission means in accordance with claim 19 wherein said shift means includes means for maintaining axial mating force on said collar when said collar is in contact with either one of said forward and reverse bevel gears.

21. A power transmission means in accordance with claim 19 and further comprising an exhaust gas passage through which exhaust gas passes and terminating in an exhaust gas discharge port, wherein said propeller has a substantially hollow cylindrical hub and is positioned aft of said exhaust gas discharge port, and wherein a substantial amount of said exhaust gas passes through said hub of said propeller when said propeller shaft is engaged with said forward bevel gear and a substantial amount of exhaust gas passes between said discharge port and said propeller hub when said propeller shaft has been urged rearwardly.

* * * * *